US005775839A

United States Patent [19]

Mazzer

[11] Patent Number: 5,775,839

[45] Date of Patent: Jul. 7, 1998

[54] PROTECTIVE WATERPROOFING MEMBRANE, PARTICULARLY FOR COATINGS OF WALLS AND PAVINGS

[75] Inventor: Luciano Mazzer, Vittorio Veneto, Italy

[73] Assignee: Tema Technologies & Materials S.R.L., Vittorio Veneto, Italy

[21] Appl. No.: 578,518

[22] PCT Filed: May 6, 1994

[86] PCT No.: PCT/IT94/00056

§ 371 Date: Mar. 14, 1996

§ 102(e) Date: Mar. 14, 1996

[87] PCT Pub. No.: WO95/01480

PCT Pub. Date: Jan. 12, 1995

[30] Foreign Application Priority Data

Jul. 2, 1993 [IT] Italy ..... TV930032 U

[51] Int. Cl.[6] ..... E02D 31/02

[52] U.S. Cl. ..... 405/50; 52/169.5; 52/169.14; 405/43; 405/36

[58] Field of Search ..... 405/36, 38, 45, 405/50, 43, 46, 47, 48, 49, 258; 52/169.5, 169.14

[56] References Cited

U.S. PATENT DOCUMENTS

| | | | |
|---|---|---|---|
| 4,436,779 | 3/1984 | Menconi et al. | 428/169 |
| 4,840,575 | 6/1989 | Freese | 52/169.5 X |
| 4,943,185 | 7/1990 | McGuckin et al. | 405/43 X |
| 5,044,821 | 9/1991 | Johnson | 52/169.5 |
| 5,383,314 | 1/1995 | Rothberg | 52/169.5 |

FOREIGN PATENT DOCUMENTS

| | | | |
|---|---|---|---|
| 24 17 039 | 10/1975 | Germany . | |
| 29 47 499 | 6/1981 | Germany . | |
| WO 93/14286 | 7/1993 | WIPO . | |
| 01480 | 1/1995 | WIPO | 405/258 |

*Primary Examiner*—Tamara L. Graysay
*Assistant Examiner*—Frederick L. Lagman
*Attorney, Agent, or Firm*—Sewall P. Bronstein; Peter F. Corless

[57] ABSTRACT

Protective waterproofing membrane particularly for exterior and/or interior coatings, of walls and pavings generally, of the types made in plastic material and comprising a plurality of protrusions all of the same side, in which, limited to the overlapping area or along the vertical junction edges, protrusions (2, 2') are provided having a different configuration in respect to the remaining surface of a sheet from a pre-determined width, said protrusions constituting respectively a male and female closure provided with a seal, which development requires both on the left and right side, an ensemble of cylindrical forms joined in groups of five, where one or the other provides a series of forms (5) also cylindrical but of a smaller diameter to the preceding and interposed in rows that are vertical to said groups.

16 Claims, 1 Drawing Sheet

PROTECTIVE WATERPROOFING MEMBRANE, PARTICULARLY FOR COATINGS OF WALLS AND PAVINGS

The present invention has for an object a protective waterproofing membrane particularly for exterior and/or interior coatings, of walls and pavings generally.

The invention, finds particular if not exclusive application among products destined to the building section, and in more detail in the installation of filled-in supporting structures, such as foundations.

In prior art the technical functional characteristics and the multifarious advantages that offer the protective membrane are known. These, especially recently, have practically replaced the somewhat empirical traditional methods of treating walls and pavings, as for example those impregnating surfaces composed of bituminous, tending predominantly to waterproofing.

As a result, said membranes, have found increasingly vast use solving, at least partly, problems that the preceding techniques could have created, which could have been, for example, a slow and difficult installation, insufficient waterproofing, the necessity to provide a drainage technique, with other disadvantages of functioning techniques which those noticeable commonly in the confrontations of a good part of the supporting structures directly in contact with the soil.

On the market it is also possible to verify that the greater part of the membranes, have characteristics decidedly common to each other. In first place, they are made in a semi-rigid plastic material, according to determined heights, to be, from one side conveniently adaptable to the surface to coat, and from the other commercialized in spools therefore easily moveable. In second place provides equidistant and complanate protrusions, distributed with uniformity and protruding if compared to the surface, as well as being made indifferently according to a section usually conic or semi-conic. Some types, can also provide rib stiffening, which in practice join vertically (in a wall coating), any protrusion. The application of the membrane on the interested surface must provide protrusions facing the wall, so obtaining an interspace having a thickness of at least equal height of said protrusions made on the membrane. Advantages of the interspace so obtained, consist in a good ventilation offering a good protection from humidity for the structures on the ground, realising at the same time an effective drainage system.

A further characteristic of the membranes, not less important than that of the preceding ones, consists in that, between sheet and adjacent sheet an overlap is possible, anchoring the respective end until obtaining a logic and complete continuity of the coating. The overlap in definitive, is possible thanks to the main configuration of protrusions which consent, overlapping itself, the insertion of one within a correspondent hollow made in contra-position from the other sheet so overlapped. Such techniques of fixed joint anchorage is known in various sectors, and one completes by- providing finishing accessories for the installation, which can consist in a closing profile of the longitudinal edge fixable to a wall and in provided fixing means of suitable washers or plugs, which hold to the wall and in provided fixing means the said membrane.

In above shown solutions, however different drawbacks are noticeable. In first place it can be affirmed that, generally, because of the type of coupling adopted it is not possible to reach a sufficient line will have connecting zones, in which both water and air can (Rufenacht) easily filter decreasing the protective effectiveness of the membrane. Furthermore, the different and inappropriate configurations of protrusions, do not consent to optimize the advantages of said membrane type. De-B-2947499 disclosed a protective membrane for modular coating of walls, of the type superimposable with an analogue for mechanical junction, obtaining the continuity of the coating, made in plastic material and comprising a central area of plurality of protrusions, all on the same side of each membrane, wherein every membrane has two opposite border joining areas provided with a series of male and female joining protrusions, in order to join the two membranes on their respective borders, to form a continuous layer, one of the borders being improved with a strip of sealing material to form a seal.

Aim of the present invention is to obviate to the above-mentioned drawbacks.

This and other aims are reached with the present innovation according to the characteristics of the included claims solving exposed problems by means of an improved protective membrane, particularly for modular coating of walls generally, of the types superimposable with an analogue for mechanical junction, obtaining the continuity of the coating, made in plastic material and comprising a central area of plurality of protrusions all on the same side of each membrane, wherein every membrane has two opposite border joining areas provided with a series of male and female joining protrusions in order to join the two membranes on their respective borders to form a continuous layer, wherein said border joining areas comprise at least two lines of said male and female joining protrusions, said lines of said male and female joining protrusions, being divided in the first of said borders by a strip of sealing material;

characterised in that:

it is used also for coating pavings;

the second of said borders have at least one row of intermediate protrusions abutting in a joining action against said strip of sealing material of the joined adjacent membrane to form a surrounding seal.

In this way a more efficient protective waterproof coating is obtained in particular because seal is obtained in a junction border line, on one side and the other of the intermediate line of the row of the intermediate protrusions, sealing being assured even between each intermediate protrusion, because the width of the strip of sealing material is larger than the diameter of each intermediate protrusion. Furthermore each protrusion, flattens the respective basis, reducing the extension of the contact surface, and avoiding bubbling for evaporation of sealing material; bubbling being captured in the respective sealed cells realized in sticking the overlapping borders.

Advantageously said protrusions are provided having a different configuration in respect to the remaining surface of a sheet, said joining protrusions constituting respectively a male and female are of cylindrical forms joined in groups of five, where one or the other provides a series of forms also cylindrical but of a small diameter to the preceding and interposed in vertical rows to said groups.

In such a way, it is possible to obtain a extremely innovative membrane and at the same time easy to use, as well as able to greatly improve the functions provided by preceding membranes. More in detail, thanks to the particular type of overlapping and waterproof junction, it is possible to protect surfaces of walls and pavings, destine to extremely bad conditions and avoid water stagnation and movements be considered limitative but preferably illustrative.

Figures 1, 2:
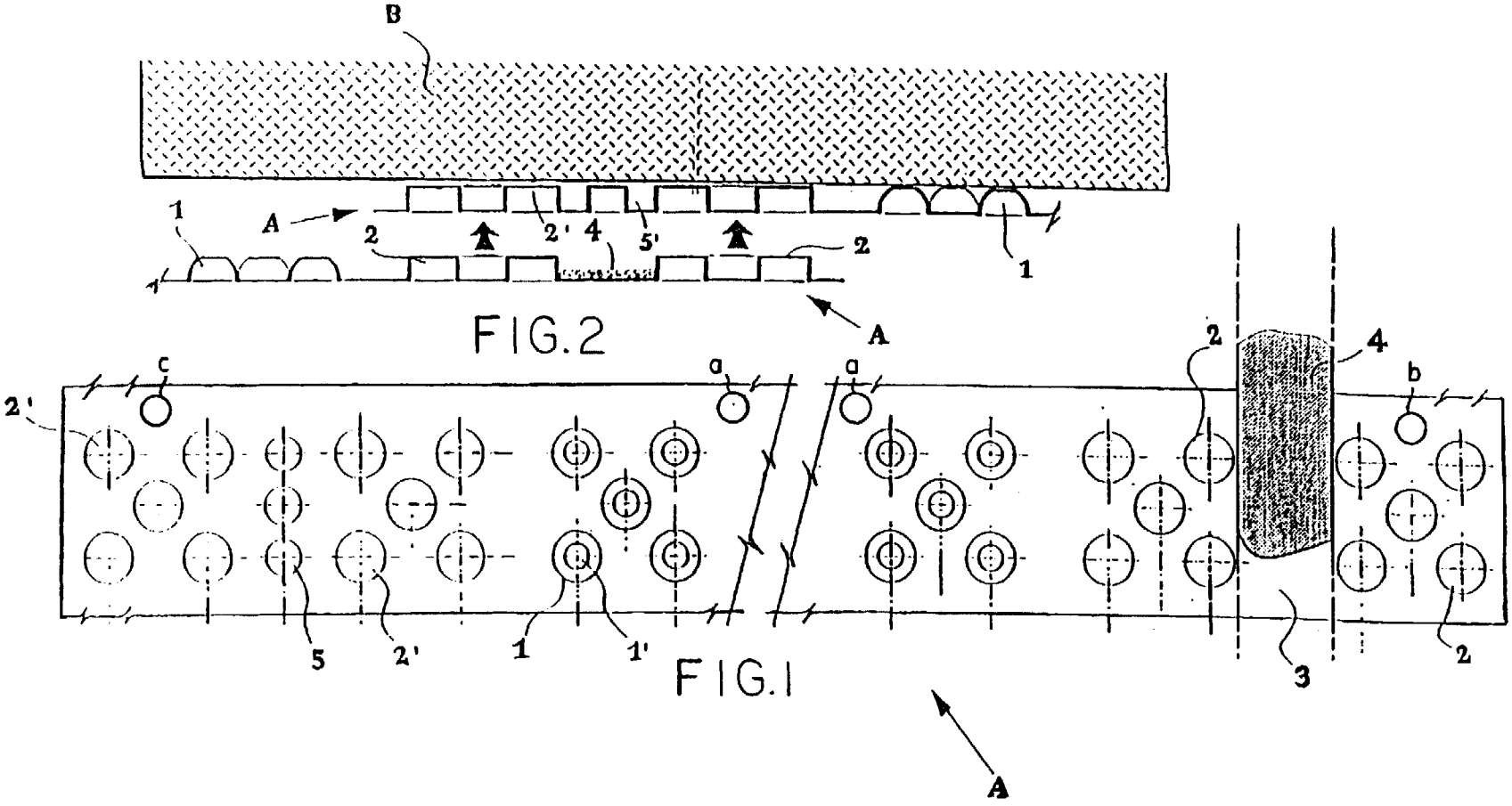
FIG. 1 represents a partial frontal view of a membrane which evidences two lateral ends of a junction for overlapping.
FIG. 2 represents a schematic view and from above of the ends of two membranes to be superimposed to make the continuity of the coating of a surface.

Making reference to the figure it is disclosed that a polymeric membrane, of the type with the drawing made for thermoformation, is available in sheets (A) from a continuous spool in the usual heights or even providing breaking lines of pre-marked modules according to the predetermined widths. Alternatively, single sheets (A) of desired sizes can be supplied, and therefore stacked.

In this case every sheet (A) provides a series of protrusions on the wall side, which configuration varies depending on the position in which they are distributed. More in detail, the sheet subdivides essentially in three protruding areas, respectively one central (a) which occupies most of the surface and two sets of joining protrusions at the end, respectively obtaining from one side a male closure (b) and from the other a female closure (c).

Said set of joining protrusions being divided;

at one side by a space (3) covered with a strip of sealing material (4);

at the other side intermediate protrusions (5).

The central area (a), that determines the thickness of the interspace of ventilation between the wall (B) and the membrane (A), is composed from a ensemble of clews (1), having a section almost semispherical with the resting plane (1'). The disposition of these clews (1) is in groups of five, aligned, respectively four perimetrical diametrically opposite and one in a central position, slightly apart from each other, until completing the sector (a) of the sheet (A).

Along the lateral ends of every sheet (A), the male (b) and female (c) joining protrusions are made disposed transversally and on the same faces, which for the overlapping of two sheets (A) consent the junction and therefore the logic continuity of a coating for surfaces. As far as regards to the male closing side (b), a series of joining protrusions (2) are made, with cylindrical section, these also grouped in five units respectively four perimetrical diametrically opposite and one in a central position. The drawing of sheet (A), provides that a first series of protrusions groups (2) both disposed in a row near the longitudinal end of the sheet (A). Parallel to said first row, a second row of protrusions are provided analogously cylindrical (2), defining among the same a space (3), in practice a longitudinal strip, which function is to contain the sealing material, as for example double sided adhesive tape (4), which besides being of help to the joints to be superimposed for a greater mechanical seal, realizes a discreet barrier (around the opposed joining protrusions) to the possible infiltrations offering a complete waterproofing. Also at the opposite end (c) of the same sheet, or on the side of the female closure, protrusions (2') are provided, with cylindrical section, grouped in fives, and respectively four perimetrical diametrically opposite and one in a central position. As a result, to allow the coupling with the male closure (a), of a same sheet (A),a first series of protrusions (2) grouped and disposed in two rows is provided, equal to this last, of which one near to the longitudinal end of the sheet (A) and one logically more internal. The elapsing space between the two rows of analogously cylindrical (2') protrusions, third protrusions (5) are provided, also cylindrical, disposed in an intermediate position and longitudinally in rows of three. Said protrusions (5) in this case, are dimensionally smaller in diameter in respect to the joining protrusions (2—2'), and consent, from the opposite surface, the end (c) of the same sheet, or on the side of the female closure, protrusions (2') are provided, with cylindrical section, grouped in fives, and respectively four perimetrical diametrically opposite and one in a central position. As a result, to allow the coupling with the male closure (a), of a same sheet (A),a first series of protrusions (2) grouped and disposed in two rows is provided, equal to this last, of which one near to the longitudinal end of the sheet (A) and one logically more internal. The elapsing space between the two rows of analogously cylindrical (2') protrusions, third protrusions (5) are provided, also cylindrical, disposed in an intermediate position and longitudinally in rows of three. Said protrusions (5) in this case, are dimensionally smaller in diameter in respect to the joining protrusions (2—2'), and consent, from the opposite surface, the obtainment of a pair of bumps (5') contrary to the preceding which, overlap the edges of the sheets (A), insisting along the strip of the seal (4).

I claim:

1. A protective membrane suitable for use for modular coating of walls and pavings generally of a type superimposable with an analogue for mechanical junction, obtaining the continuity of the coating, made in plastic material and comprising a central area of plurality of protrusions all on a same side of each membrane, wherein the membrane has a first border joining area and an opposite second border joining area provided with a series of male and female joining protrusions to join two of said membranes on their respective borders to form a continuous layer, one of the borders being provided with a sealing material to form a seal, said first and second border joining areas comprising:

at least two lines of said male and female joining protrusions, said lines of said male and female joining protrusions being divided, the first of said borders by the sealing material;

the second of said borders having at least one row of protrusions abutting in a joining action against said sealing material of the joined adjacent membrane to form a seal surrounding said protrusions.

2. A membrane of claim 1 wherein the membrane joining protrusions comprise male and female closures arranged on longitudinal sides in an ensemble of forms in groups, and a series of third forms in an intermediate position and interposed between said groups.

3. A membrane of claim 2 wherein the membrane joining protrusions comprise a series of male closures grouped in five units respectively four diametrically opposite and one in a central position, and in which a first series of males closures is disposed in a row proximate to the longitudinal end of a membrane sheet, and parallel to the first row is provided a second row of males closures defining a space.

4. A membrane of claim 3 wherein the male protrusions are cylindrical in section.

5. A membrane of claim 2 wherein on opposite ends of a same membrane sheet, or on the side of the female closure, being logically correspondent, the ends are provided with:

protrusions, with cylindrical section, grouped in fives, and respectively four diametrically opposite and one in a central position, said grouped protrusions comprising a first, second and third series, the first protrusions series proximate to the vertical end of the sheet;

the second protrusions series located more internally than said first series of protrusions;

the third protrusions series disposed intermediately with respect to the first and second protrusions series and vertically in rows of three in the elapsing space between the first and second protrusions series.

6. A membrane of claim 5 wherein the protrusions of the third series are dimensionally smaller in diameter in respect to protrusions of the first and second series, and from the opposite side, obtain a pair of bumps contrary to the preceding which, overlap the edges of the sheets, along the sealing material.

7. A membrane of claim 2 wherein a central area that determines thickness of interspace of ventilation between a wall and the membrane is comprises a clews ensemble, having a section substantially semispherical base provided with a resting plane.

8. A membrane of claim 1 wherein the membrane joining protrusions comprise a series of male closures grouped in five units respectively four diametrically opposite and one in a central position, and in which a first series of males closures is disposed in a row proximate to the longitudinal end of a membrane sheet, and parallel to the first row is provided a second row of males closures defining a space.

9. A membrane of claim 8 wherein the male protrusions are cylindrical in section.

10. A membrane of claim 8 wherein the sealing material is a double-sided adhesive tape.

11. A membrane of claim 1 wherein the sealing material is in a form of a strip.

12. A membrane of claim 1 wherein on opposite ends of a same membrane sheet, or on the side of the female closure, being logically correspondent, the ends are provided with:

protrusions, with cylindrical section, grouped in fives, and respectively four diametrically opposite and one in a central position, said grouped protrusions comprising a first, second and third series, the first protrusions series proximate to the vertical end of the sheet;

the second protrusions series located more internally than said first series of protrusions;

the third protrusions series disposed intermediately with respect to the first and second protrusions series and vertically in rows of three in the elapsing space between the first and second protrusions series.

13. A membrane of claim 12 wherein the protrusions of the third series are dimensionally smaller in diameter with respect to protrusions of the first and second series, and from the opposite side, obtain a pair of bumps contrary to the preceding which, overlap the edges of the sheets, along the sealing material.

14. A membrane of claim 1 wherein a central area that determines thickness of interspace of ventilation between a wall and the membrane comprises a clews ensemble, having a section substantially semispherical base provided with a resting plane.

15. A spool comprising a plurality of attached membranes of claim 1, the attached membranes each segregated by breaking lines that define a size of each membrane.

16. A plurality of membranes of claim 1 in a stacked arrangement.

* * * * *